United States Patent [19]

Oess

[11] Patent Number: 4,719,388

[45] Date of Patent: Jan. 12, 1988

[54] FLAT ELECTRON CONTROL DEVICE UTILIZING A UNIFORM SPACE-CHARGE CLOUD OF FREE ELECTRONS AS A VIRTUAL CATHODE

[75] Inventor: Frederick G. Oess, San Mateo County, Calif.

[73] Assignee: Source Technology Corporation, Los Gatos, Calif.

[21] Appl. No.: 765,413

[22] Filed: Aug. 13, 1985

[51] Int. Cl.[4] ..... G09G 3/10

[52] U.S. Cl. ..... 315/169.1; 313/422; 313/495; 313/302; 315/169.3; 315/366

[58] Field of Search ..... 315/169.1, 169.3, 169.4, 315/366, 167; 313/422, 423, 448, 495, 496, 302; 340/720

[56] References Cited

U.S. PATENT DOCUMENTS

| | | | |
|---|---|---|---|
| 2,318,418 | 5/1943 | Pierce | 313/448 |
| 4,121,130 | 10/1978 | Gange | 313/302 |
| 4,341,980 | 7/1982 | Noguchi et al. | 313/422 |
| 4,564,790 | 1/1986 | Veith | 313/422 |

FOREIGN PATENT DOCUMENTS

| | | | |
|---|---|---|---|
| 033545 | 8/1981 | European Pat. Off. | 313/495 |

*Primary Examiner*—Saxfield Chatmon

*Attorney, Agent, or Firm*—Flehr, Hohbach, Test, Albritton & Herbert

[57] ABSTRACT

A flat visual display device is disclosed herein and includes a flat face plate having a front face and an opposite back face and electrically positive means on the latter which, as a result of the impingement of the electrons thereon, provides a visual image through the front face of the face plate. The device utilizes an arrangement including cathode means for establishing a uniformly dense space-charge cloud of free electrons within a planar band parallel with and rearward of the back face of the display face plate. Means including an apertured address plate disposed in spaced-apart confronting relationship with the back face of the face plate between the latter and the uniform space-charge cloud acts on the electrons within the cloud in a controlled way so as to cause the electrons acted upon to impinge on specific areas of the electrically positive back face plate means of the display face plate in order to produce a desired image through the face plate's front face.

30 Claims, 5 Drawing Figures

FLAT ELECTRON CONTROL DEVICE UTILIZING A UNIFORM SPACE-CHARGE CLOUD OF FREE ELECTRONS AS A VIRTUAL CATHODE

The present invention relates generally to flat electron control devices and more particularly to a specifically designed flat visual display device which differs significantly from the prior art.

A typical prior art approach to flat cathode ray visual display devices is shown in FIG. 1. This figure diagrammatically illustrates part of a prior art high vacuum device which is generally indicated by the reference numeral 10. This high vacuum device 10 includes a face plate assembly 12 having a face plate 14 and an electrically positive phosphorescent coated and aluminized back face 16 (also referred to as screen or anode) which as a result of the impingement of electrons thereon, provides a visual image as viewed from front face of plate 14. While the face plate is shown flat, it can be made slightly curved (defining a relatively large radius) for manufacturing purposes, as can all of the otherwise flat components making up the overall device. This is also true for the device of the present invention. For purposes herein, the term "flat" is intended to include those slight curvatures. Spaced rearward of the screen and in front of a back plate 18 and backing electrode 19 are a series of thermionically heated wire cathodes 20 disposed in a plane parallel with both the screen and back plate. Each of the cathodes is responsible for producing its own supply of free electrons in a cloud around and along the length of itself, as generally indicated by the individual clouds 22. These free electrons are acted upon by a grid stack 24 comprised of addressing electrodes, a buffer electrode, focusing electrodes and, in some cases, deflecting means all of which will be discussed immediately below, so as to cause the electrons acted upon to impinge on specific areas of the screen 16 of face plate assembly 12 in order to produce a desired image at front face of plate 14. For purposes of description, the planes containing the cathodes, screen, grid stack and back plate will be defined by the x and y-axes and the axis perpendicular thereto will be the z-axis.

Still referring to FIG. 1, the grip stack 24 of electrodes includes an electrically isolated buffer electrode 25, one or more apertured address plates 26 and one or more focusing electrodes, two of which are exemplified at 28 and 30. As an example of the address plate 26, the latter may include a dielectric substrate 32 having a front face 36, a back face 38 and closely spaced apertures 40 extending in the z-direction between these faces in an array of rows and columns. This particular address plate illustrated also includes a first set of parallel strip address electrodes 42 disposed on the back face of substrate 32 and a second set of parallel strip address electrodes 44 normal to electrodes 42 on front face 36. For purposes of discussion, the address electrodes 42 will be referred to as the first address electrodes and the electrode strips 44 will be referred to as the second address electrodes, as these are the closest and second closest address electrodes to the supply of electrons. It should be noted that while electrodes 42 are the first address electrodes, the buffer electrode 25 is actually the first electrode in the stack. The components making up overall display device 10, as described thus far, are conventional components and, hence, will not be discussed in any further detail. Also, it is to be understood that not all of the components making up device 10 have been illustrated. For example the overall device includes a housing or envelope which may or may not integrally incorporate face plate 12 and back plate 18 but which nevertheless defines an evacuated interior containing the phosphorescent coated electrically positive screen 16, backing electrode 19, cathode 20 and the grid stack 24 described above. The device also includes gas absorption devices such as getters to maintain high vacuum, suitable means for energizing the cathodes 20 in order to produce their respective clouds of free electrons 22, for providing a controlled positive unidirectional field, and means not shown for voltage biasing the various other electrodes including placing a bias on backing electrode 19 with respect to the cathode voltage, in order to act on free electrons produced by the cathodes in an attempt to cause those electrons acted upon to move in a relatively uniform stream and with relatively uniform z axis velocity toward the buffer electrode. Throughout this process, the buffer electrode 25 is maintained at a positive voltage relative to the cathode voltage, thereby taking a positive role in drawing electrons to it. At the same time, means (not shown) are provided for addressing (by appropriately voltage biasing) selected sectors of the first and second control electrodes at any given time in order to draw electrons through specific apertures 40 and in the direction of screen 16. Once those electrons pass through the selected apertures, the remaining electrodes 28 and 30 (and any others if they are provided) function to focus or deflect or otherwise further direct the electrons passing therethrough onto the screen. It is to be understood that device 10 has been provided as a generalized example of some categories of the prior art and is not intended to incorporate all of the features of prior art devices or represent a specific device. For example, other prior art devices may utilize a different arrangement of addressing and focusing electrodes and/or may provide different types of individual cathodes. However, in each of the prior art aplications of the type generally illustrated in FIG. 1 (of which applicant is aware), a spatially non-uniform supply of free electrons is produced and acted upon directly by the buffer, addressing and focusing electrodes (and possibly deflecting electrodes) in order to produce the desired image. In the case of device 10, the clouds 22 of free electrons surrounding cathodes 20 provide such a supply which is acted upon directly by the grid stack 24.

Flat display devices exemplified by device 10 have been found to produce visual displays which tend to vary uncontrollably in brightness from a spatial standpoint. There are two basic causes for this "washboarding" effect. First, there are density variations in the free electrons produced by and relative to the cathode wires. More specifically, the number of free electrons approaching the grid stack immediately behind and available to one sector of the address plate might differ from the amount behind and available to another sector. Therefore, even if two different apertures are addressed for the same amount of time with the intent of causing the same number of electrons to pass therethrough in order to provide equally illuminated pixels on the screen, different amounts might in fact pass through the apertures and therefore result in pixels having entirely different illumination intensities. The second washboarding effect is a result of the wide angle approach of some of the electrons being caused to move into a given aperture being addressed. These "wide angle" electrons tend to pass through the particular aperture off axis, thereby making focusing variable. Ideally, one way to eliminate the washboarding effect described is to provide device 10 with a cathode 20 directly behind and in close proximity and precisely spaced with respect to each and every aperture 40 so that each of these apertures could draw from similar reservoirs of electrons. In that way, if any two or more apertures are addressed for the same amount of time, they would under ideal conditions draw the same number of electrons and therefore illuminate the screen with the same degree of intensity. However, it should be apparent that from a practical standpoint there are far to many apertures in the address plate to provide an equal number of cathodes, nor could cathodes and spacing be made precisely identical.

Another drawback of devices exemplified by device 10 resides in its use of buffer electrode 25. As stated above, this electrode is maintained at a positive voltage relative to the cathode voltage. As a result, the buffer electrode acts as a constant current drain as does the backing electrode if the latter is maintained at a positive voltage.

Exemplary device 10 is one approach to flat visual display devices. Another approach is illustrated in U.S. Pat. Nos. 4,227,117; 4,451,846; and 4,158,210. These patents describe devices which use a series of focusing, deflecting and accelerating electrodes working in unison to produce an array of individual scanning electron beams on a cooperating electrically positive screen. While devices of this type do not generally have washboarding problems, they are subject to cathode emission variations and problems associated with deflection distortion and borderline registration. In still another prior art approach, electrons are produced by means of a plasma generated cloud by means of an address stack in front of the cloud and directed onto an electrically positive screen. A problem with this technique is that the light output on the screen is limited (weak). There are also other known disadvantages to this approach.

Another category of flat display devices utilizes single, multiple or ribbon beams directed initially essentially parallel to the plane of the display and then caused to change directions essentially in the Z direction to address appropriate areas of the display target either directly or by way of a selecting and/or focusing grid structure. Examples are the Aiken and Gabor devices, U.S. Pat. Nos. 2,928,014 and 2,795,729, respectively, using single guns, the RCA multibeam channel guide system as exemplified by U.S. Pat. Nos. 4,103,204 and 4,103,205 and the Siemens A.G. controlled slalom ribbon device (U.S. Pat. No. 4,437,044). The major drawback of these systems resides in their construction and/or electrical and electron optical control complexities. The Siemens approach issued in U.S. Pat. No. 4,435,672 by Heynisch utilizes a cathode region permeated by very low velocity electrons described as having velocities of 1 to 2 volts and described variously as "electron reservoir," "electron cloud," "cloud of low velocity electrons," "electron storage space" and "electron gas." The problem areas involve:

1. The ability to maintain density uniformity, since even minor magnetic fields will disturb the uniformity of the space charge cloud, such as those occasioned by the earth's magnetic field or those generated by currents in the circuitry;

2. The lack of adequate electron density due to the relatively large volume required for the overall cathode space; and 3. There is no reasonably fixed cathode distance which can act as a virtual cathode for the purpose of controlling the subsequent focusing action required to obtain small, well defined spots at the screen.

In view of the foregoing, it is a general object of the present invention to provide a flat high vacuum visual display device which is not subject to the nonuniformity or washboarding effects discussed above nor excessively sensitive to magnetic fields.

Another general object of the present invention is to provide a flat visual display device which is energy efficient in operation.

A more particular object of the present invention is to provide a flat visual display device including a grid stack incorporating address electrodes and a supply of free electrons for use by the address electrode, but specifically a device in which the electrodes forming part of the stack or any other electrodes do not draw any appreciable current or power from the free electrons during operation of the device.

Another particular object of the present invention is to provide a flat visual display device of the last-mentioned type but one in which all addressed apertures of its grid stack pass the same number of electrons for a given increment of time, whereby to insure against the nonuniformity or washboarding effect described above.

As will be described in more detail hereinafter, the device disclosed herein includes a planar receptor, for example a flat display screen which may be identical to the one forming part of device 10, that is, a face plate assembly having a front face and a coated electrically positive back face and means on the latter which, as a result of impingement of electrons thereon, provides a corresponding visual image as viewed from the face plate's front face. However, the present invention does not require that the planar receptor be a visual display screen. It could be, for example, an end plane of individual electronic leads to activate other devices such as a liquid crystal display. However, for purposes of discussion, the receptor will be described as a display screen and the overall device will be referred to as flat visual display device. This device also includes a grid stack which may be identical to stack 24 forming part of device 10 in FIG. 1 or an arrangement which only includes the apertured address plate. In addition and in accordance with the present invention, the flat visual display device disclosed herein utilizes an arrangement including cathode means for establishing a uniformly dense space-charge cloud of free electrons within a planar band parallel with and just rearward of the back side of the first address grid so that each and every aperture in the address plate sees and acts upon and equal supply of electrons during operation of the device.

It is furthermore a requirement that the above noted dense planar space charge cloud form a virtual cathode, i.e., the density of the cloud must be such that the electric field within the cloud must at some plane (e.g., within the band referred to above) at least drop to cathode potential or slightly below. It is to be clearly understood that whenever the text refers to the phrase "space charge cloud" this requirement is included. Also, the terms "space charge cloud" or "virtual cathode" may be used interchangeably.

In one specific embodiment illustrated herein, the uniformly dense space-charge cloud of free electrons or "virtual cathode" is established by means of a backing electrode and an accelerator electrode in combination with the previously described first address electrode of the device's grid stack, all three acting on electrons supplied by suitable cathode means such as cathodes 20 in FIG. 1. As will be described in detail hereinafter, these three components cooperate with one another in order to cause free electrons emitted by the cathode means to oscillate back and forth in a pendulum-like fashion between two planar bands, one behind and adjacent to the first address electrode and one in front of and adjacent to the backing electrode.

In the same specific embodiment illustrated herein, the first address electrode is maintained at a bias voltage which is at most equal or slightly negative with respect to the cathode means during quiescence of the overall device (e.g., when no addressing takes place). This ensures that, during the quiescent period, the space-charge cloud adjacent the address plate is at all times spatially separated from the first address electrode. As a result, there is no current passage into that electrode from the free electrons. This is to be contrasted with device 10 in which its buffer electrode continuously drains current from its cathode means. Hence the device illustrated herein may be operated in a more energy efficient manner, as will become more apparent hereinafter.

The overall flat visual display device disclosed herein will be described in more detail hereinafter in conjunction with the drawings wherein.

Figure 2:
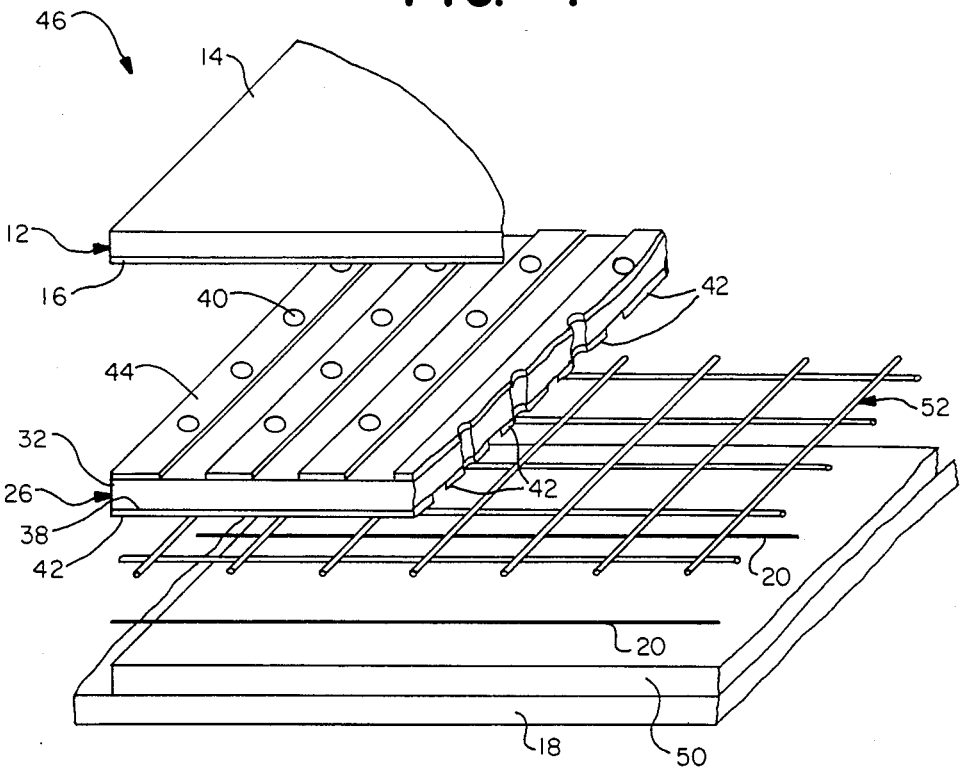
FIG. 2 is a partially broken away exploded perspective view of a flat visual display device designed in accordance with one embodiment of the present invention.
Figure 3:
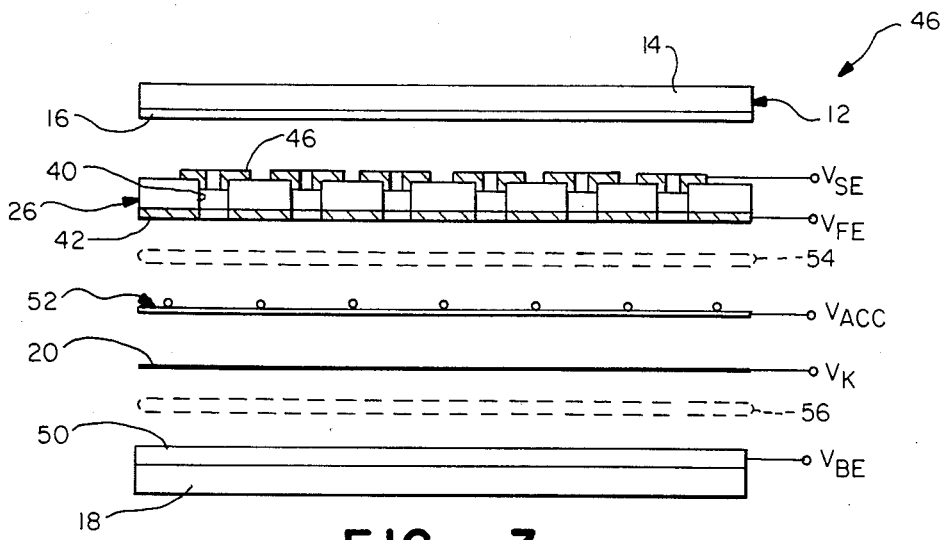
FIG. 3 is a diagrammatic illustration, in side elevation, of the device of FIG. 2.
Figure 4:
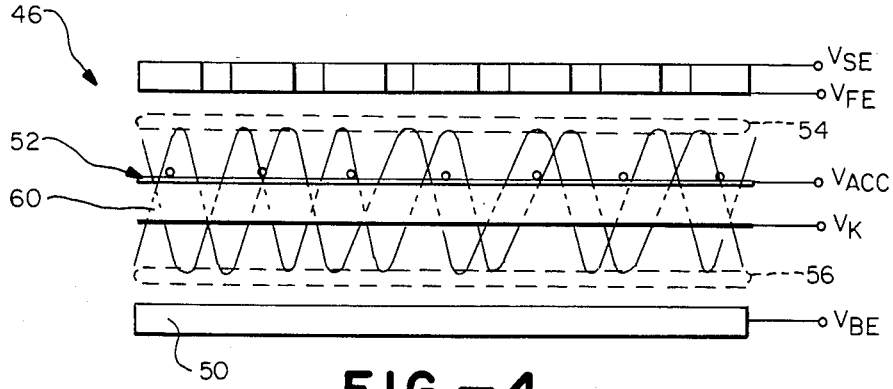
Figure 5:
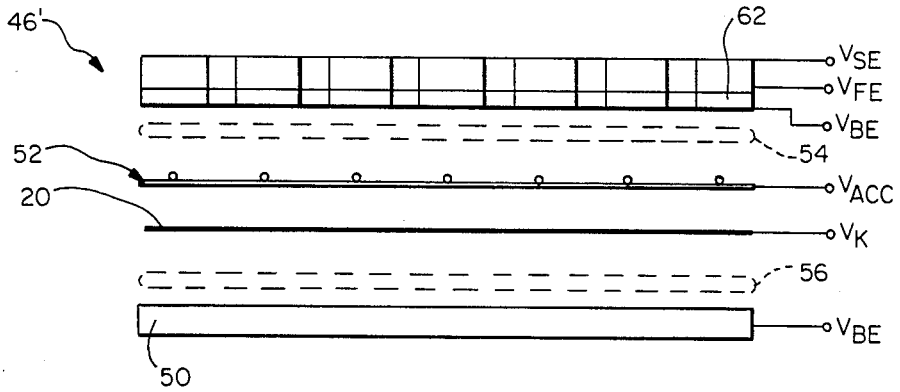

FIG. 4 diagrammatically illustrates operational aspects of the device of FIGS. 2 and 3; and FIG. 5 is a diagrammatic illustration, in side elevation, of a flat visual display device designed in accordance with a second embodiment of the present invention.

Figure 1:
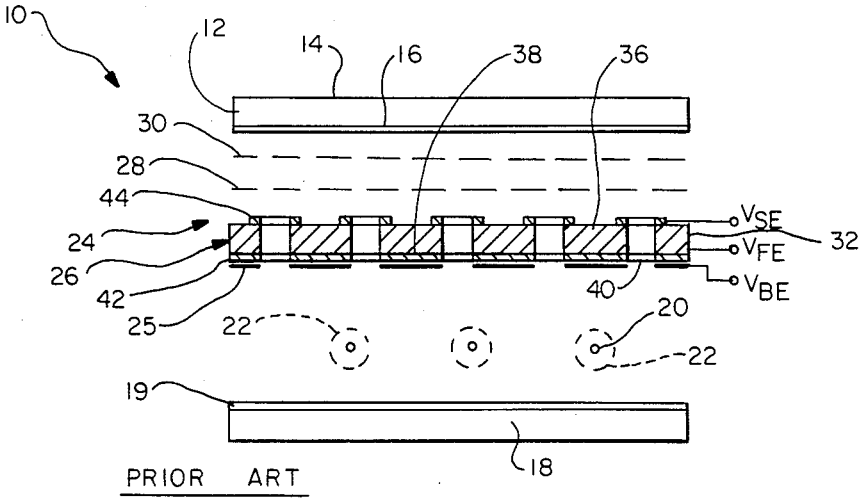
FIG. 1 is a diagrammatic illustration, in side elevation, of a flat display device designed in accordance with the prior art.

Turning now to the drawings, wherein like components are designated by like reference numerals throughout the various Figures, attention is immediately directed to FIGS. 2 and 3, as FIG. 1 has been discussed previously. FIG. 2 illustrates a flat visual display device which is designed in accordance with the present invention and which is generally indicated by the reference numeral 46. This device may include the same face plate assembly 12 (or other such planar receptor), back plate 18, cathodes 20, and apertured address plate 26, as described previously with respect to device 10 illustrated in FIG. 1. The apertured address plate 26 is located directly behind and in parallel relationship with the phosphorescent coated and aluminized back face 16 of face plate assembly 12. The addressing electrodes 42 are shown extending in one direction on the back face 38 of the address plate's substrate 32 and second addressing electrodes 44 extend in normal directions on the opposite side of the address plate. The apertures 40 in the address plate are illustrated in both FIGS. 2 and 3.

Note that device 46 does not necessarily include or at least does not have to include (although it may include) additional focusing, deflecting and/or addressing electrodes between the address plate and screen corresponding to focusing electrodes 28 and 30 and other such electrodes which may make up the grid stack 24 in device 10. Also note that the wire-like cathodes in device 46 run parallel to G1 electrodes 42 rather than perpendicular to these electrodes, as in device 10 This has been done for purposes of illustration and has no significant effect on the operation of overall device 46. The cathodes could run in either direction. Finally, it should be noted that device 46 has an outermost envelope which, while not shown in its entirety, includes face plate 14 and back plate 18 and defines an evacuated chamber containing the phosphorescent screen 16 of the display face plate, wire-like cathodes 20 and address plate 26 as well as other components to be discussed hereinafter.

In addition to the components thus far described, overall flat visual display device 46 includes a plate like backing electrode 50 located behind cathodes 20 in a plane adjacent to and parallel with (and possibly supported by) backing plate 18 and a grid-shaped accelerator electrode 52 disposed within a plane parallel with and between address plate 26 and cathode wires 20. The way in which these two additional components operate in device 46 will be described hereinafter. For the moment it suffices to say that these two additional components in combination with those described previously establish a first uniformly dense space-charge cloud or virtual cathode 54 of free electrons in a planar band (e.g., a flat layer having thickness) disposed in parallel relationship with and immediately behind the first address electrodes 42 and a second uniformly dense space-charge cloud 56 of free electrons in a planar band in parallel relationship with and immediately in front of backing electrode 50. As will be seen, space-charge cloud 54 is essential to the operation of device 46 while space-charge cloud 56 is a result of the way in which the space-charge clouds are established and is not otherwise essential to the operation of the device. Therefore, all discussions henceforth will be directed primarily to space-charge cloud 54, although it will be understood that the space-charge cloud 56 includes identical attributes.

From the way in which space-charge cloud 54 is established, as will be described, it will be apparent that this reservoir of free electrons has essentially zero forward and rearward z-axis velocities (e.g., in the direction normal to the plane of address plate 26) and a random Maxwellian cross beam velocity (parallel to the plane of the address plate) and thus the electric field at any point within the cloud is essentially zero. Stated another way, each and every point or sub-area within space-charge cloud 54 at a given planar distance from the first address electrode 42 includes essentially the same density of free electrons displaying the same essentially zero field conditions as each and every other point or sub-area. In that way, "virtual cathodes" which are identical to one another are established at each and every aperture 40 immediately behind addressing electrodes 42. As electrons are drawn from these virtual cathodes by the apertures during the addressing mode of the device, the voids they leave are immediately filled so as to preserve the uniformity of the overall cloud, provided the number of electrons emitted is well in excess of the current which is drawn by the grid stack and accelerator electrode as will be discussed. This is because the cloud 54 is made to be sufficiently dense, in the manner to be described hereinafter, as compared to the number of free electrons drawn to the addressed aperture, so that addressing the cloud by the aperture has minimal effect on the cloud's field. When electrons are drawn from the cloud, the tendency of cloud to maintain equilibrium causes an instant redistribution in which electrons in the immediate surrounds move in to fill the void. This assures that each aperture has a continuous supply of electrons to draw from and that each supply is the same as the other.

Having described space-charge cloud 54 and before describing how this cloud is established, attention is directed to the way it is utilized in combination with addressing plate 26 for directing controlled beams of electrons from the cloud through selected apertures 40 and on to screen 16 in order to produce a desired visual image on the latter. To this end, certain nomenclature should be noted. Specifically, those apertures which are energized or addressed are ones which are caused to direct electrons from cloud 54 towards screen 16. On the other hand, those apertures which are not energized or addressed are maintained electronically closed to the passage of electrons.

Whether any specific aperture is addressed or not depends upon the voltages on the particular first and second addressing electrodes 42 and 44 which orthogonally cross that aperture. In the case where no apertures are being addressed, that is, during the quiescent mode, the first addressing electrodes are maintained (biased) at a voltage at most equal or slightly negative with respect to cathodes 20 while the second address electrodes are also maintained at zero or a negative cutoff voltage. Thus, in the case where no apertures are being addressed, none of the electrons from cloud 54 are attracted to the the address plate and thus there is no current drained by either of the address electrodes and hence no power is consumed. This is to be distinguished from device 10 where there is continuous current drain in the grid stack through the buffer electrode 25 which is always maintained at a positive voltage with respect to its cathodes 20.

If a buffer electrode is used in the stack the first address electrode does not necessarily have to be zero or negative but it must be such that in combination with the buffer no current will flow into the grid stack past the first address electrode. In some cases a slight amount of positive voltage on the buffer which will not consume a large amount of power may be of advantage as a means of producing focusing.

The precise "cutoff" voltages on each set of address grids must be adjusted so that no current due to field penetration will flow as a result of the turn-on pulse voltage of the other. If a buffer electrode is used in front of the first address electrodes, as will be described with respect to FIG. 5, then the combination field established with the latter must function the same as the first address electrode without the presence of a buffer.

In order to energize or address a particular aperture, its specific first and second address electrode must both be energized to voltage levels positive with respect to the cathode potential. For purposes herein, it is to be understood that the cathode potential or the cathode reference voltage is its unipotential value during the addressing mode of the overall device. If cathodes 20 are directly heated structures, then there must be a non-addressing mode or period in order to heat up the cathodes. During this non addressing mode of the device, the cathode potential must be zero or positive with respect to the first addressing electrode at all points. If the cathodes are indirectly heated, then there is no need for a non-addressing mode. Because the first address electrode associated with the specific aperture being addressed during the address mode is increased to a voltage above that of the cathode, there will be a certain amount of power consumed as a result of electrons attracted to the rest of the energized first address electrode from cloud 54. However, the resulting current drain is negligible due to the fact that only a relatively small number of pixels are simultaneously addressed such as for example those in a single or a double line or column along the first address electrode and therefore the power loss is negligible.

Having described space-charge cloud 54 and the way in which address plate 26 is operated, attention is now directed to FIG. 4 which illustrates how the space-charge cloud 54 is established. It will be assumed at the outset that the entire address plate 26 is in a quiescent mode, that is, each of its apertures remains in an unaddressed state. Under this condition, the first address electrode voltage (indicated at $V_{FE}$) remains at its cut off value equal or slightly negative with respect to the cathode voltage $V_k$. As stated previously, the voltage on the second address electrode (indicated at $V_{se}$) is maintained at cutoff. At the same time, the backing electrode 50 is maintained at a voltage $V_{BE}$ which is close to $V_{FE}$, that is equal or slightly negative with respect to the cathode voltage $V_k$. With the specific cathode system shown and for specific spacing it may at times be advisable to operate the backing electrode very slightly positive in order to increase cathode emission without however absorbing appreciable current in comparison to the increased emission. On the other hand, the voltage $V_{acc}$ on accelerator electrode 52 is maintained at a positive level with respect to the cathode voltage and both $V_{FE}$ and $V_{BE}$.

It should also be noted that the device must be so constructed that the side wall in the regions aft of the grid structure are at backing electrode potential. This will enclose the free electrons within the confines of the back plate side walls, and grid stack during quiescent operation, and the accelerator will therefore be the only current collector.

Under the voltage biasing conditions just recited, as electrons are emitted from wire-like cathodes 20, they will be drawn from the cathode toward the accelerator electrode and a percentage thereof will actually be intercepted by the accelerator mesh in some finite time period. Due to inertia, the remainder will move through the mesh-like accelerator electrode toward first address electrodes 42. The fraction of electrons not intercepted by the accelerator grid will be roughly equal to the transmission characteristic of the grid, which for purposes of discussion will be assumed to be approximately 95%. This means that each time a given number of electrons are attracted towards the accelerator plate, 95% will pass therethrough and 5% will not. As stated above, the first address electrodes are biased at a voltage level equal to or slightly negative with respect to the cathode voltage. Accordingly, repulsive forces are created between these electrodes and the oncoming electrons, thereby slowing down the latter and eventually causing them to momentarily stop and be repelled back towards the accelerator electrode. Upon returning to the accelerator mesh, a fraction of those electrons, for example 5%, will be intercepted by the accelerator while the others pass therethrough and move toward the backing electrode. Since the backing electrode is at the same voltage as the first address electrode, the oncoming electrons will be turned back towards the accelerator electrode and the process will repeat itself in a pendulum like manner.

The action just described is diagrammatically illustrated by the overlapping waveforms 60 in FIG. 4. Note that the electrons bunch in planar bands parallel with and adjacent to the first address and backing electrodes as their velocities go to zero in the direction normal to the accelerator electrode (e.g., in the Z-direction). The velocities of the electrons go to zero at slightly different distances from the first address and backing electrodes, thereby partially accounting for the thickness of the bands. This is because the electrons are emitted from the cathode at different thermal velocities, (within a relatively tight range) and therefore approach the electrodes at slightly different energies. As a result they tend to bunch within the bands so defined, thereby resulting in the previously described space-charge clouds 54 and 56. At the same time, the electrons forming the clouds tend to move in random directions parallel with the accelerator electrode (e.g., in the x and y directions). However, the space-charge fields in these latter directions tend to cancel themselves out, thereby resulting in a space-charge cloud effectively having a zero field in all directions, as discussed previously.

It should be apparent from the foregoing that the proximal region of space-charge clouds 54 and 56 with respect to the first address electrode and backing electrode 50 respectively, depend in large part on the voltage values on these latter electrodes and that of the accelerator electrode. Additionally, the proximal regions of the space charge clouds from the accelerator grid are essentially functions of the current density passing through the accelerator grid and the voltage of the accelerator grid. The value of this dimension can be assessed from the Child Langmuir equation for a planar diode $$J=(a^2\, V_{acc}{}^{3/2}/x_o{}^2)$$

where

"J" is the current density passing through the accelerator

"$a^2$" is a constant equal to $2{,}335\times10^{-6}$ amperes per volt

"Vacc" is the accelerator voltage $x_o$ is approximately the zero potential boundary of the space charge for given values of the above current and voltages neglecting thermal velocity Restated, $$x_o=(a\, V_{acc/3}/J^{\frac{1}{2}}) \text{ in unit distance}$$

The same also holds for the space between the accelerator and the backplate assuming that the cathode structure is not present. This of course requires a design somewhat different from the given example.

If the potential at the first electrode (either the first address electrode or a buffer electrode) in the grid stack is ideally equal to cathode potential then the electron velocities in the space between $x_o$ and the first grip stack element will be essentially thermal in the z direction as well as in the xy plane.

Negative values will result in a linear negative gradient which will cause the proximal boundary of the space charge to the grid strack to be pushed back and cause the virtual cathode band (e.g. the space charge cloud) to be pushed away from the grid and the space charge will become narrower and denser. This will tend to increase the need for higher voltages in the addressing conditions of the first address grid or the combination of address grid and buffer electrode.

A slightly positive value at the stack entrance will cause the Child Langmuir law to become effective in the $x_o$-to-stack region with the stack entrance voltage now being entered in the equation and $x_o$ being the distance from the potential minimum, to the stack entrance.

From the above discussion and the desire to keep power levels low and pulse amplitudes at a minimum, for obvious reasons, then the design functions must be adjusted so that 1. $V_{acc}$ be reasonably low
2. The density of electrons adjacent to the stack be high
3. $x_o$ distance from the accelerator be greater than that from the grid structure Compromises for purposes of focusing can of course be made as noted before.

It should be noted that a virtual cathode or uniform space charge cloud will always exist provided that emission current is greater than the current absorbed by the grid structure and the target or screen. Typical values of voltages and other parameters are for example $V_{BE}=0V$ $V_{acc}=15$ to 20 V Stack entrance field (quiescent) close to 0 V Accelerator to grid stack spacings $=0.070$ Cathode emission$=1$ ma/in$^2$ of display area In the way of a simple restatement the following should be noted.

An object of the invention is to be able to adjust the position of the cloud 54 with respect to the address plate 26 in order to adjust the focusing and intensity or brightness capabilities of the overall device. Also, by placing the cloud as close as possible to the first addressing electrode, the amount of energy required to draw electrons into and through given apertures being addressed is minimized. At the same time "cross talk" between apertures is also minimized. This means that electrons are drawn through one aperture being addressed and not adjacent ones unaddressed and will not influence the display status (brightness and/or focus) of adjacent apertures.

One way to ensure that the space-charge cloud 54 is as close as possible to the first address electrodes is to position the accelerator electrode as close as possible to the first address electrodes, while, at the same time, maintaining $V_{FE}$ as close as possible but negative with respect to the cathode voltage $V_k$. In this way, the space-charge cloud is forced into a small dense band width between the two. In this latter regard, the accelerator electrode should not be so close to the first address electrode so as to shadow approaching electrons. At the same time, it is desirable to minimize the spacing between cathodes 20 and the accelerator electrode in the specific design noted so that the voltage on the accelerator can be maintained at a minimum level to provide a given emission current. The closer the accelerator electrode is to the cathodes, the lower the voltage need be for a given current. Thus, by minimizing the voltage at a given current (by minimizing the cathode/accelerator spacing), the energy consumed can be minimized. While still referring to the positional relationship of the cathodes and accelerator electrode, the latter is preferably between the cathodes and address plate 26 as illustrated. However, for the design described here the accelerator electrode could be located on the opposite side of the cathodes as well. More specifically, referring to FIG. 4, because of the evident symmetry of space-charge clouds 54 and 56, the positions of the cathode and accelerator electrode can be interchanged.

In actual practice, a typical address plate is subjected to both line and column addressing. Depending upon the application of overall device 46, the first address electrodes will be used for line or column addressing and the second address electrodes will be used in the opposite way. If the stack structure is not used as a storage system then the device is best operated as a line or column sequential system. That is to say that if line sequential addressing is used then the first address electrode is turned on sequentially one line at a time and all columns are addressed simultaneously for each line. Thus the grid stack and screen combination tends to absorb closely the same fraction of the cathode current and therefore aid in maintaining display brightness and focus uniformity. In the case column sequential addressing the columns are sequentially addressed on the first control grid and all lines are addressed simultaneously on the second control grid. If the columns or line array which are addressed simultaneously are split then two lines or columns respectively can be addressed on the first address electrode at an increased trade-off of brightness or line or column count.

The purpose of addressing a potential grid-like buffer electrode 62 as shown in device 46 of FIG. 5 to the grid stack at the input side of the grid stack provides a means of controlling the space charge for the purpose of focus adjustment or to maintain a near zero entrance field to the stack should it be necessary to use a negative or perhaps positive first selection electrode to produce a proper cut-off level at this electrode. This latter device 46', except for its buffer electrode 62, is identical to device 46 and includes all of the components described above along with the buffer electrode. This latter electrode is operated at a voltage so that the entrance potential to the grid stack is zero or slightly negative with respect to the cathode voltage $V_k$. In that way, the space-charge cloud 54 is established just rearward of the buffer electrode.

In either device 46 or device 46', the means for providing a supply of free electrons was described as parallel cathode wires and the accelerator electrode was described as grid-shaped. It is to be understood that these and the other components making up device 46 or 46' could vary in design without departing from the spirit of the invention. For example, the cathodes do not have to be in the form of parallel cathode wires or wires at all so long as a suitable supply of electrons are provided at the appropriate location within the device to establish the desired space-charge cloud.

What is claimed is:

1. A flat visual display device, comprising:

(a) a flat face plate having a front face, an opposite back face, and means on the latter which, as a result of the impingement of electrons thereon, provides a visual image at said front face;

(b) an arrangement including cathode means for establishing a uniform space-charge cloud of free electrons defining a planar band which functions as a virtual cathode, which is spaced-apart from said cathode means and which is parallel with and rearward of the back face of said display face plate, said arrangement including means other than said cathode means for causing some of said free electrons to oscillate back and forth more than once between said planar band and a second spaced-apart location,; and (c) address means disposed in spaced-apart, confronting relationship with the back face of said face plate between the latter and said uniform space-charge cloud for acting on electrons within said cloud in a controlled way so as to cause the electrons acted upon to impinge on specific areas of the electrically positive screen of said face plate in order to produce a desired image at the front face of said face plate.

2. A device according to claim 1 wherein said address means includes an address plate and wherein said address plate includes; an apertured dielectric substrate having a front face confronting said face plate and a back face confronting said space-charge cloud; a first electrode array positioned on the back face of said substrate; a second electrode array positioned on the front face of said substrate; and means for voltage biasing said electrode arrays in a manner which causes the address plate to act upon electrons within said cloud in said controlled way, whereby to produce said desired image at the front face of said face plate.

3. A device according to claim 2 wherein said cathode means serves to provide a supply of free electrons behind said address plate, and wherein said arrangement for establishing said uniform space-charge cloud includes said first electrode array which also forms part of said address means along with said cathode means and also a voltage biased backing electrode extending in a plane parallel with and behind said space-charge cloud and a voltage biased grid-shaped accelerator electrode extending in a plane parallel with and between said space-charge cloud and said backing electrode, said first electrode array, backing electrode and accelerator electrode together serving as said means other than said cathode means.

4. A device according to claim 3 wherein, during the time the address means does not act on any electrons within said cloud, the voltage bias on each of said first electrode array and backing electrode is at most at or slightly negative with respect to the charges on said free electrons supplied by said cathode means so as to repel the latter and wherein the voltage bias on said accelerator electrode is positive with respect to the cathode means, whereby for any given increment of time a percentage of the electrons supplied by said cathode means will be collected by said accelerator electrode while the remainder of those electrons so supplied will oscillate between planar bands adjacent said first electrode array and said backing electrode as they are drawn back and forth to and through the accelerator electrode, thereby establishing said first-mentioned space-charge cloud within the planar band adjacent to said first electrode array and a second uniform space-charge cloud within a planar band adjacent to said backing electrode.

5. A device according to claim 2 wherein said cathode means includes a plurality of parallel wire-like cathodes within a plane parallel with and behind said space-charge cloud for providing a supply of free electrons behind said cloud, and wherein said arrangement for establishing said uniform space-charge cloud includes said first electrode array along with said wire-like cathodes and also a backing electrode extending in a plane parallel with and behind said wire-like cathodes and a voltage biased accelerator electrode extending in a plane parallel with and between said space-charge cloud and said wire-like cathodes, said first electrode array, backing electrode and accelerator electrode together serving as said means other than said cathode means.

6. A device according to claim 5 wherein, during the time the address means does not act on any electrons within said cloud, the voltage bias on each of said first electrode array and backing electrode is substantially always at or is slightly negative with respect to said wire-like cathodes so as to repel the free electrons and wherein the voltage bias on said accelerator electrode is positive with respect to said wire-like cathodes, whereby for any given increment of time a percentage of the electrons supplied by said cathode means will be collected by said accelerator electrode while the remainder of those electrons so supplied will oscillate between planar bands adjacent said first electrode array and said backing electrode as they are drawn back and forth to and through the accelerator electrode, thereby establishing said first-mentioned space-charge cloud within the planar band adjacent said first electrode array and a second space-charge cloud within a planar band adjacent said backing electrode.

7. A device according to claim 2 wherein said cathode means serves to provide a supply of free electrons behind said address plate, and wherein said arrangement for establishing said uniform space-charge cloud includes said cathode means along with a voltage biased grid shaped buffer electrode extending in a plane parallel with and between said address plate and space-charge cloud, a voltage biased backing electrode extending in a plane parallel with and behind said space-charge cloud and a voltage biased grid shaped accelerator electrode extending in a plane parallel with and between said space-charge cloud and said backing electrode, said buffer electrode, backing electrode and accelerator electrode together serving as said means other than said cathode means.

8. A device according to claim 7 wherein the voltage bias on each of said buffer electrode and backing electrode is at or slightly negative with respect to the potential of said cathode means so as to repel said free electrons and wherein the voltage bias on said accelerator electrode is positive with respect to said cathode means, whereby for any given increment of time a percentage of the electrons supplied by said cathode means will be collected by said accelerator electrode while the remainder of those electrons so supplied will oscillate between planar bands adjacent said second electrode array and said backing electrode as they are drawn back and forth to and through the accelerator electrode, thereby establishing said first-mentioned space-charge cloud within the planar band adjacent to said buffer electrode and a second space-charge cloud within the planar band adjacent to said backing electrode.

9. A device according to claim 8 wherein said cathode means includes a plurality of parallel wire-like cathodes disposed within a plane parallel with and between said space-charge cloud and said backing electrode for providing said supply of free electrons.

10. A flat visual display device, comprising:

(a) a flat face plate having a front face and opposite back face and electrically positive means on the latter which, as a result of impingement of electrons thereon, provides a visual image at said front face;

(b) cathode means for providing a supply of free electrons in an area behind and spaced from said face plate;

(c) address means including an apertured address plate disposed in spaced-apart, confronting relationship with the back face of said face plate between the latter and said area containing said supply of free electrons;

(d) a backing electrode extending in a plane parallel with and behind said area;

(e) a grid-shaped accelerator electrode extending in a plane parallel with and between said address means and said backing electrode within said area; and (f) means for voltage biasing said address means and said backing and accelerator electrodes in a way which causes the three to act on the free electrons supplied by said cathode means within said area to establish a uniform space-charge cloud of free electrons defining a planar band which is spaced-apart from said cathode means and which is parallel with and between said address plate and accelerator grid, said planar band of free electrons functioning as a virtual cathode which is remote with respect to said cathode means, whereby the address plate is able to act on electrons supplied by said virtual cathode in a controlled way so as to cause the electrons acted upon to impinge on specific areas of the back face of said face plate in order to produce a desired image at the front face of the face plate.

11. A device according to claim 10 wherein said cathode means includes a plurality of wire-like cathodes within a plane parallel with said face plate and in said area.

12. A device according to claim 11 wherein said accelerator electrode is disposed between said wire-like cathodes and said address plate.

13. A device according to claim 10 wherein said address means includes a buffer electrode between said address plate and said accelerator electrode.

14. A flat electron control device, comprising:

(a) means defining an electron receiving plane;

(b) an arrangement including cathode means for establishing a uniform space-charge cloud of free electrons defining a planar band which functions as a virtual cathode, which is spaced-apart from said cathode means and which is parallel with and rearward of said receiving plane, said arrangement including means other than said cathode means for causing some of said free electrons to oscillate back and forth more than once between said planar band and a second spaced-apart location,; and (c) address means disposed in spaced-apart, confronting relationship with said receiving plane between the latter and said uniform space-charge cloud for acting on electrons within said cloud in a controlled way so as to cause the electrons acted upon to be directed into specific areas of said receiving plane.

15. A method of producing a visual image on the front face of a flat display face plate having said front face and an opposite back face and means on the latter which, as a result of the impingement of electrons thereon, provide said visual image at said front face, said method comprising the steps of:

(a) providing electrons from cathode means and acting on said free electrons for establishing a uniform space-charged cloud of free electrons defining a planar band which functions as a virtual cathode, which is spaced-apart from said cathode means, and which is parallel with and rearward of the back face of said display face plate, said free electrons being acted upon by means other than said cathode means such that some of the free electrons acted upon oscillate back and forth more than once between said planar band and a second spaced-apart location;

(b) providing address means in spaced-apart, confronting relationship with the back face of said face plate between the latter and said uniform space-charge cloud; and (c) operating said address means so as to cause the latter to act on electrons within said space-charge cloud in a controlled way so as to cause the electrons acted upon to impinge on specific areas of the back face of said face plate in order to produce said image at the front face of said face plate.

16. A method of controlling the flow of free electrons into an electron receiving plane, comprising the steps of:

(a) providing free electrons from cathode means and acting on said free electrons for establishing a uniform space-charge cloud of free electrons defining a planar band which functions as a virtual cathode, which is spaced-apart from said cathode means, and which is parallel with and rearward of said receiving plane, said free electrons being acted upon by means other than said cathode means such that some of the free electrons acted upon oscillate back and forth more than once between said planar band and a second spaced-apart location; and (b) acting on the electrons within said cloud in a controlled way so as to cause the electrons acted upon to be directed into specific areas of said receiving plane.

17. In a device which requires the use of free electrons, an arrangement for supplying said free electrons, said arrangement comprising means including cathode means for establishing a uniform space-charge cloud of free electrons in the form of a planar band at a location remote from said cathode means, said planar band of free electrons functioning as a virtual cathode which is remotely located with respect to said actual cathode means, said arrangement including means other than said cathode means for causing some of said free electrons to oscillate back and forth more than once between said planar band and a second spaced-apart location.

18. In a flat electron control device including means defining an electron receiving plane, a supply of free electrons, and address means including an address plate having a plurality of spaced-apart apertures therethrough, said address means being disposed in spaced-apart confronting relationship with and behind said receiving plane and configured to act upon free electrons from said supply in a controlled way to cause the electrons acted upon to be directed through specific ones of the apertures and into specific areas of said receiving plane, the improvement comprising:

(a) cathode means for producing free electrons at a location remote from said address plate; and (b) means not including said cathode means acting on free electrons for causing some of the electrons acted upon to oscillate back and forth more than once between two spaced-apart locations for establishing space-charge clouds of free electrons whch form virtual cathodes at said locations immediately adjacent and behind said apertures in said address plate and which serve as said supply of free electrons to be acted upon by said address means, each of said space-charge clouds displaying a uniform density of free electrons which is greater than the density of free electrons filling the space between said clouds and remotely located source of free electrons, at least during the operation of said device when the supply of free electrons are not being acted upon by said address means.

19. The improvement according to claim 18 wherein the space-charge cloud of free electrons behind any given one of said apertures has substantially the same uniform density of free electrons as the other clouds behind the other apertures.

20. The improvement according to claim 19 wherein said means for establishing a space-charge cloud of free electrons behind each of said apertures includes means for establishing a continuous overall cloud defining a generally planar band parallel with said address plate whereby different sections of said overall cloud provide said first mention clouds immediately adjacent and behind respective ones of said apertures.

21. The improvement according to claim 18 wherein said means for producing a source of free electrons includes a plurality of wire-like cathodes spaced rearwardly of said address plate and said space-charge clouds.

22. In a flat electron control device including means defining an electron receiving plane, a supply of free electrons, and address means including an address plate having a plurality of spaced-apart apertures therethrough, said address means being disposed in spaced-apart confronting relationship with and behind said receiving plane and configured to act upon free electrons from said supply in a controlled way to cause the electrons acted upon to be directed through specific ones of the apertures and into specific areas of said receiving plane, the improvement comprising:

(a) cathode means for producing a source of free electrons at a location remote from said address plate; and (b) means not including said cathode means acting on said free electrons for causing a portion of the electrons acted upon to oscillate back and forth more than once between (i) first locations immediately adjacent and behind said apertures and spaced from said cathode means whereby to form concentrated clouds of free electrons that function as remote virtual cathodes at said first locations in order to serve as said supply of free electrons acted upon by said address means, and (ii) second locations further behind said apertures whereby to form concentrated clouds of free electrons at said second locations.

23. In a method of operating a flat electron control device including means defining an electron receiving plane, a supply of free electrons, and address means including an address plate having a plurality of spaced-apart apertures therethrough, said address means being disposed in spaced-apart confronting relationship with and behind said receiving plane and configured to act upon free electrons from said supply in a controlled way to cause the electrons acted upon to be directed through specific ones of the apertures and into specific areas of said receiving plane, the improvement comprising the steps of:

(a) producing from cathode means free electrons at a location remote from said address plate; and (b) without the aid of said cathode means, acting on said free electrons for causing some of the electrons acted upon to oscillate back and forth more than once between two spaced-apart locations for establishing space-charge clouds of free electrons which form virtual cathodes at predetermined locations immediately adjacent and behind said apertures in said address plate and serving as said supply of free electrons to be acted upon by said address means, each of said space-charge clouds displaying a uniform density of free electrons which is greater than the density of free electrons filling the space between said clouds and remotely located source of free electrons, at least during the operation of said device when the supply of free electrons are not being acted upon by said address means.

24. In a method of operating a flat electron control device including means defining an electron receiving plane, a supply of free electrons, and address means including an address plate having a plurality of spaced-apart apertures therethrough, said address means being disposed in spaced-apart confronting relationship with and behind said receiving plane and configured to act upon free electrons from said supply in a controlled away to cause the electrons acted upon to be directed through specific ones of said receiving plane, the improvement comprising the steps of:

(a) producing free electrons at a first location remote from said address plate using suitable means to do so; and (b) without the aid of said suitable means, acting on said free electrons for causing a portion of the electrons acted upon to oscillate back and forth more than once between (i) second locations immediately adjacent and behind said apertures and remote from said first location whereby to form concentrated clouds of free electrons that function as virtual cathodes at said first location in order to serve as said supply of free electrons acted upon by said address means and (ii) third locations further behind said apertures whereby to form concentrated clouds of free electrons at said third locations.

25. In a flat electron control device including means defining an electron receiving plane, a supply of free electrons, and means acting on the free electrons in a controlled manner in order to direct the electrons acted upon into said electron receiving plane, the improvement comprising:

(a) means for producing free electrons at a specific location; and (b) means acting on said free electrons for causing a portion of the electrons acted upon to oscillate back and forth more than once between (i) a first planar band remotely located with respect to said specific location so as to form a planar band of concentrated cloud to free electrons that functions as a virtual cathode at said first remote location in order to serve as said supply of free electrons and (ii) a second planar band remotely located relative to said first planar band location so as to form a second concentrated planar band of free electrons at said second location.

26. A method of operating a flat electron control device including means defining an electron receiving plane, a supply of free electrons, and means acting on the free electrons in a controlled manner in order to direct the electrons acted upon into said electron receiving plane, the improvement comprising the steps of:

(a) producing a source of free electrons at a specific location; and (b) acting on said source of free electrons for causing a portion of the electrons acted upon to oscillate back and forth more than once between (i) a first planar band remotely located with respect to said specific location so as to form a planar band of concentrated cloud of free electrons that functions as a virtual cathode at said first remote location in order to serve as said supply of free electrons and (ii) a second planar band remotely located relative to said first planar band so as to form a second concentrated planar band of free electrons at said second location.

27. In a high vacuum display device which comprises a planar cathodeluminescent screen and planar control electrode means reponsive to applied voltages for permitting passage of electrons therethrough in areas subject to external selection, the combination of:

a cathode structure comprising a plurality of thermionically electron-emissive elements arranged substantially within a plane;

means for defining a boundary potential parallel with and spaced behind said cathode structure;

a planar accelerating electrode highly transparent to electrons and positioned between said cathode structure and said control electrode means;

said cathode structure and said accelerating electrode being substantially parallel to said control electrode means;

said cathode structure, said boundary potential defining means, said accelerating electrode and said control electrode means jointly defining a space in which electrons are trapped and forced to oscillate back and forth between two regions of high electron density, the first being near the boundary potential defining means, the second being adjacent and parallel to said control electrode means and constituting a virtual cathode which is remote from said cathode structure and from which electrons may be drawn to the screen as commanded by the control electrode means.

28. In a high vacuum electron control device which includes planar control electrode means responsive to applied voltages for permitting passage of electrons therethrough in areas subject to external selection, the combination of:

cathode means for providing a supply of free electrons within a given plane spaced behind said planar control electrode;

means defining a boundary potential parallel with and spaced from said given plane;

a planar accelerating electrode highly transparent to electrons and positioned between said given plane and said control electrode means;

said given plane and said accelerating electrode being substantially parallel to said control electrode means;

said boundary potential defining means, said accelerating electrode and said control electrode means jointly defining a space in which said free electrons are trapped and forced to oscillate back and forth between two regions of high electron density, the first being adjacent said boundary potential defining means, the second being adjacent and parallel to said control electrode means and constituting a virtual cathode which is remote from said cathode means and from which electrons may be drawn to the screen as commanded by the control electrode means.

29. In a flat electron control device including means defining an electron receiving plane, free electrons, and address means disposed in spaced-apart confronting relationship with and behind said receiving plane and configured to act upon free electrons from said supply in a controlled way to cause the electrons acted upon to be directed into specific areas of said receiving plane, the improvement comprising:

(a) first means at a location remote from said address plate for providing free electrons during operation of said control device; and (b) second means separate from said first means acting on said free electrons for causing a portion of the electrons acted upon to oscillate back and forth between (i) a first location immediately adjacent and behind said apertures whereby to form a concentrated cloud of free electrons at said first locations in order to serve as said supply of free electrons acted upon by said address means, and (ii) a second location further behind said apertures whereby to form a concentrated cloud of free electrons at said second locations;

(c) said second means being configured such that, for any particular group of free electrons supplied by said first means at any given point in time, at least some of the electrons from that group will oscillate back and forth between said locations a number of times.

30. In a method of operating a flat electron control device including means defining an electron receiving plane, free electrons, and address means disposed in spaced-apart confronting relationship with and behind said receiving plane and configured to act upon free electrons from said supply in a controlled way to cause the electrons acted upon to be directed into specific areas of said receiving plane, the improvement comprising the steps of:

(a) using cathode means, providing free electrons at a location remote from said address plate during operation of said control device; and (b) acting on said source of free electrons without the aid of said cathode means for causing a portion of the electrons acted upon to oscillate back and forth between (i) a first location immediately adjacent and behind said apertures whereby to form a concentrated cloud of free electrons at said first locations in order to serve as said free electrons acted upon by said address means and (ii) a second location further behind said apertures whereby to form a concentrated cloud of free electrons at said second location;

(c) said step of acting on said electrons being such that, for any particular group of free electrons supplied by said cathode means at any given point in time, at least some of those electrons from that group will oscillate back and forth between said locations a number of times.

* * * * *

UNITED STATES PATENT AND TRADEMARK OFFICE

CERTIFICATE OF CORRECTION

PATENT NO. : 4,719,388

DATED : January 12, 1988

INVENTOR(S) : Frederick G. Oess

It is certified that error appears in the above-identified patent and that said Letters Patent is hereby corrected as shown below:

Column 3, line 34, after "means of", delete "a" and insert --plasma.--

Column 3, line 35, before "plasma generated", insert --The electrons are extracted out of a --.

Column 4, line 52, after "upon", delete "and" and insert --an--.

Column 5, line 32, after "exploded", insert --,--.

Column 7, line 5, after "immediate", delete "surrounds" and insert --surroundings--.

Column 17, line 27, before "tc cause", delete "away" and insert --way--.

Signed and Sealed this

Eleventh Day of October, 1988

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,719,388

DATED : January 12, 1988

INVENTOR(S) : Oess

It is certified that error appears in the above—identified patent and that said Letters Patent is hereby corrected as shown below:

Column 7, line 3, after "tendency of", insert -- the --.

Column 17, line 42, after "said", delete [first] and insert -- second --.

Column 19, line 27, after "first", delete [locations] and insert -- location --.

Column 19, line 32, after "second", delete [locations] and insert -- location --.

Signed and Sealed this

Twenty-eighth Day of February, 1989

*Attest:*

DONALD J. QUIGG

*Attesting Officer*

*Commissioner of Patents and Trademarks*